US006341544B1

(12) United States Patent
Falzone

(10) Patent No.: US 6,341,544 B1
(45) Date of Patent: Jan. 29, 2002

(54) ADJUSTABLE HEAD WRENCH

(76) Inventor: Loren P. Falzone, 333, Mountain Rd., Basking Ridge, NJ (US) 07920

( * ) Notice: Subject to any disclaimer, the term of this patent is extended or adjusted under 35 U.S.C. 154(b) by 0 days.

(21) Appl. No.: 09/621,062

(22) Filed: Jul. 21, 2000

(51) Int. Cl.[7] ..... B25B 13/18
(52) U.S. Cl. ..... 81/128; 81/13
(58) Field of Search ..... 81/128, 13; 279/123

(56) References Cited

U.S. PATENT DOCUMENTS

| | | | | | |
|---|---|---|---|---|---|
| 1,530,842 | A | * | 3/1925 | Matoushek | 81/128 |
| 4,136,588 | A | | 1/1979 | Roder | 81/165 |
| 4,366,733 | A | * | 1/1983 | Colvin | 81/128 |
| 4,520,698 | A | | 6/1985 | Martinmaas | 81/128 |
| 4,676,125 | A | | 6/1987 | Ardelean | 81/53.2 |
| 4,864,901 | A | | 9/1989 | Le Duc | 81/163 |
| 4,874,181 | A | * | 10/1989 | Hsu | 279/144 |
| 4,884,480 | A | | 12/1989 | Briese | 81/128 |
| 4,892,016 | A | | 1/1990 | Anderson | 81/128 |
| 4,911,040 | A | * | 3/1990 | Kim | 81/128 |
| 5,067,376 | A | | 11/1991 | Fosella | 81/115 |
| 5,375,489 | A | | 12/1994 | McClure | 81/128 |
| 5,386,749 | A | | 2/1995 | Kim | 81/185 |
| 5,448,931 | A | * | 9/1995 | Fossella et al. | 81/63.2 |
| 5,819,607 | A | * | 10/1998 | Carnesi | 81/128 |
| 5,893,306 | A | * | 4/1999 | Owoc | 81/60 |
| 5,996,446 | A | | 12/1999 | Lee | 81/128 |
| 6,000,300 | A | | 12/1999 | Plamondon | 81/90.2 |
| 6,073,522 | A | * | 6/2000 | Carnesi | 81/128 |

* cited by examiner

*Primary Examiner*—Joseph J. Hail, III
*Assistant Examiner*—David B. Thomas
(74) *Attorney, Agent, or Firm*—Kenneth P. Glynn

(57) ABSTRACT

The present invention is an adjustable head wrench which may be attached to a manual drive mechanism or a power drive mechanism. It includes an attachment feature for connecting it to the drive and has a main body which contains three symmetrically arranged jaws. These three jaws each have two adjacent gripping surfaces which form an angle of about 120° to accommodate corners and adjacent surfaces of a hexagonal fastener, such as a hex screw, bolt or nut. The three jaws open and close by rotation and counter-rotation of an adjuster.

11 Claims, 4 Drawing Sheets

ADJUSTABLE HEAD WRENCH

BACKGROUND OF THE INVENTION

1. Field of the Invention

The present invention relates to an adjustable head wrench which may be attached to a socket wrench handle, to a power tool or as an integral part of a power tool. It uniquely provides for adjustment of size for rotation of hexagonal fasteners, while providing for all six flat surface contacts and three symmetrical point-to-point contacts during operation.

2. Information Disclosure Statement

The following patents represent various types of adjustable wrench arrangements:

U.S. Pat. No. 4,136,588 to Peter G. Roder describes an aligned sliding jaw key set for use with any standard ratchet wrench. The device is adaptable to being made up in kits that include three jaw keys in different sizes so that they replace nine to twelve solid sockets of different sizes in metric and American standards. Each of the jaw keys has a set of jaws each one of which is provided with an angular gripping portion able to fit and hold tightly onto the sides of nuts and bolts.

U.S. Pat. No. 4,366,733 to David S. Colvin describes a socket for torquing nuts and bolt heads which includes adjustable jaws biased in an outward radial direction by associated helical springs whose inner ends are engaged with a seat preferably embodied by a ball. A support member includes slideways that mount slides of the jaws for inward and outward adjusting movement, and each jaw has an inwardly facing engagement surface inclined with a slight inward inclination in an axial direction away from the slide thereof so as to accommodate for clearance between the slide and the associated slideway by jaw tilting that permits gripping of a nut or bolt head with surface-to-surface contact. A camming surface on each jaw is engaged by a camming surface on a sleeve of the socket and defines an angle greater than 90° with the path of jaw movement so as to facilitate jaw adjustment and prevent any binding of the jaws during such adjustment.

U.S. Pat. No. 4,520,698 to Werner W. Martinmaas describes an adjustable socket for a socket wrench or the like which has a body member with two side plates, and between the side plates are jaw members which are concurrently movable parallel to the side plates to adjust the space between confronting jaw elements on the free ends of the jaw members. Pin and slot connections are used to change the positions of the jaw members. One embodiment of the invention provides for automatic adjustment when the socket is pushed against a hex-head fastener; and a second embodiment provides for manual adjustment by sliding an operating yoke forwardly on the body member.

U.S. Pat. No. 4,676,125 to Jeffrey L. Ardelean describes an improved adjustable socket for use with a ratchet wrench drive handle to loosen or tighten bolts, nuts and other threaded workpieces, which is comprised of a hollow cylindrical casing having a passive end adapted to receive a wrench handle protuberance, an opposing work end adapted to fit about a workpiece and a sidewall interconnecting such ends with one another and defining a cavity therebetween. A plurality of uniformly spaced apart through-openings are provided in the casing sidewall between the opposing ends thereof and a cylindrically shaped gripping member is pivotally mounted along a vertical eccentric axis thereof within each through-opening so as to be selectively moveable into and out of the casing cavity. In use, the adjustable socket is mounted onto a wrench handle and positioned about a threaded workpiece. An adjustment ring is then rotatably moved, say downwardly, so that a beveled surface thereof contacts a corresponding beveled surface of each gripping member and causes each gripping member to radially move inwardly into the casing cavity whereby a convex work face of each gripping member contacts the periphery of the workpiece. Upon application of torque to the wrench handle, each work face is continually urged into intimate gripping contact with the workpiece so as to drive it in a desired direction. Upon release/reversal of the torque force and upward movement of the adjustment ring, each gripping member is urged, via a biasing means, radially outwardly of the casing cavity so as to disengage from the workpiece.

U.S. Pat. No. 4,864,901 to Don le Duc describes and adjustable wrench socket of the screw adjustment type in which two identical jaws facing each other have a multiple non-slip grip on nut and screw heads and in which the jaw movements are synchronized in respect to the axis of their mutual housing that slidably engages them but controls them in all other unwanted directions and further provides for adaptability to commercial drives and their extensions.

U.S. Pat. No. 4,884,480 to Tim K. Briese describes an adjustable socket which provides continuous sizing from a minimum opening to a maximum opening to accommodate differently sized nut structures. The socket includes a socket body having a head portion and a pair of longitudinal wing portions separated by a channel region defined by a slideway region and a keyway region. A pair of jaw members are provided, each having a slide element received in the keyway region for transverse reciprocal movement and a jaw element projecting longitudinally of its slide element and received in the slideway region. When mounted, the jaw elements have facing interior work faces and oppositely facing, exterior cam surfaces. The wing portions are externally threaded and threadably receive a collar. Biasing springs apply restorative force tending to separate the jaw elements to open the region between the work faces. The collar bears against the cam surfaces and acts in constraining opposition to the biasing springs whereby constrained selective adjustment of the opening for the nut structure is obtained. The slide elements are otherwise freely slidable transversely in the keyway region, but they include interlock structure to prevent longitudinal movement in the socket body. An indexed area may cooperate with the collar to indicate the nut structure opening size in conventional units.

U.S. Pat. No. 4,892,016 to J. E. C. Anderson describes an adjustable socket having a driver rotatably driveable about a central axis, wherein the driver includes inclined slideways extending with both radial and axial components with respect to the central axis. Jaws are supported within corresponding slideways of the driver for movement with respect to the central axis. The jaws each include an internal driver aperture having an axis transverse to the central axis. An adjuster provided with the socket includes a jaw operating member, jaw clips and a connection that secures the jaws, jaw operating member and jaw clips to maintain the socket in the assembled condition and to limit inward movement of the jaws. The jaw operating member includes an annular flange projecting outwardly in a radial direction with respect to the central axis to axially locate the jaw clips. Mating helical surfaces support the adjuster on the driver for axial adjusting rotation to move the jaws axially and concomitantly inwardly and outwardly in the slideways for size adjustment of the jaws between open and closed positions.

U.S. Pat. No. 5,067,376 to Gregory Fosella describes an adjustable wrench which has a drive shaft adapted to be turned by a conventional ratchet wrench. A housing is mounted on the output end of the shaft and three equidistantly spaced jaws are mounted between the shaft and surrounding housing. Cam surfaces are on the jaws and inside of the housing so that housing rotation in one direction will open the jaws and in the other direction will close them. A ratchet mechanism connects the shaft to the housing.

U.S. Pat. No. 5,375,489 to Travis McClure describes an automatically adjustable socket transferring torque a range of bolt heads sizes in either direction which comprises a pair of jaws slidable angled to a center cylinder and urged outward to a receiving position so that when the socket is set upon a bolt head the bolt head impresses the jaws towards the center cylinder, angularly so that the jaws maintain a parallel orientation to the bolt head faces. An upper cylinder and a lower cylinder surrounding the center cylinder each having complementary double arch rims interact as torque is applied to the upper cylinder, first to separate the two cylinders the bottom cylinder further impressing the jaws upon the bolt head until the jaws are maximally closed upon the bolt head the double arch rims then providing a torque transfer means from the upper cylinder to the lower cylinder. The lower cylinder transfers torque to the jaws through torque transfer surfaces to the jaws tangential to the bolt head. The invention also contemplates adapting jaws gripping surfaces to transfer torque to other configurations of objects to be torqued and adapting the socket to different sources of torque.

U.S. Pat. No. 5,386,749 to Kwang-Moo Kim describes a socket for a socket wrench comprising a socket body having a socket cavity formed at a lower portion of the socket body to extend vertically and a through hole, a pair of facing half sockets with different sizes fitted in the socket cavity to slide vertically, and an adjusting mechanism provided at an upper portion of the socket body and adapted to selectively adjust the vertical slide movements of the half sockets. The adjusting mechanism includes an adjusting member having an upper rod portion inserted into the through hole of the socket body such that its upper end is outwardly protruded from the through hole and a lower adjusting portion having a lower end of a long oval shape, a compression coil spring fitted around the upper rod portion and adapted to urge the adjusting member downward, and an adjusting knob including a coupling hole for forcedly fitting the protruded upper end of the upper rod portion of the adjusting member therein and a lug formed at a lower surface of the adjusting knob and adapted to temporarily fix the position of the adjusting member.

U.S. Pat. No. 5,996,446 to Han Young Lee describes a size adjustable wrench socket which is disclosed which has a plurality of jaws which are slidably engaged within a jaw guide for moving radially inward and outward relative to the jaw guide for fitting threaded fasteners of various sizes. A controller sleeve is configured for engaging upwardly extending protuberances of the jaws, such that rotation of the controller sleeve in various directions will have moved the jaws inward and outward relative to the jaw guide. The jaws further include a plurality of upwardly extending teeth which are formed into planar shoulders of intermediate portions of the jaws. A latch member is provided having a planar surface from which a plurality of teeth downwardly extend for engaging the upwardly extending teeth of the planar shoulders of the intermediate portions of the jaws. The latch member is movable from a latched position to a released position. When disposed in the latched position, the teeth of the latch member engage the upwardly extending teeth of the jaws to latch the jaws in a fixed position relative to the jaw guide. In the released position, the teeth of the latch member are spaced apart from the teeth of the jaws such that the jaws are movable relative to the jaw guide. The teeth of the jaws and the jaw guide are sized to provide indexed positions at which the jaws are spaced apart to correspond with predetermined, standard sizes of drive heads for threaded fasteners.

U.S. Pat. No. 6,000,300 to Walter J. Plamondon describes an adjustable socket wrench which has only two components, namely, a collet driver with movable jaws and a circumscribing adjustable sleeve. Positive detent positioning of the fastener engaging jaws is obtained by rotation of the adjusting sleeve which radially moves the jaws inwardly or outwardly without axial movement of any parts.

Notwithstanding the prior art, the present invention is neither taught nor rendered obvious thereby. The aforesaid prior art describes many forms of adjustable wrench arrangements, yet none teach or suggest the present invention device using three symmetrical, single piece "shoulder" units which simultaneously create surface-to-surface contacts on all six sides of a fastener, point-to-point symmetric contacts on three points of the fastener, and "shoulder" the three contacted points with a surface-to-surface, point-to-point, surface-to-surface arrangement with a single jaw.

SUMMARY OF THE INVENTION

The present invention is an adjustable head wrench which may be attached to a manual drive mechanism or a power drive mechanism. It includes an attachment feature for connecting it to the drive and has a main body which contains three symmetrically arranged jaws. These three jaws each have two adjacent gripping surfaces which form an angle of about 120° to accommodate corners and adjacent surfaces of a hexagonal fastener, such as a hex screw, bolt or nut. The three jaws open and close by rotation and counter-rotation of an adjuster.

By the present invention, advantages not realized heretofore are achieved in adjustable heads. These include, simultaneously:

(a) all six sides of a hexagonal fastener are contacted (gripped) during engagement and torquing;

(b) three alternating corners of a hexagonal fastener are contacted during engagement and torquing;

(c) all six of the flats (flat surfaces) of a hexagonal fastener are contacted during engagement and torquing; and, (d) one corner and the two adjacent flats (one on each side of the corner) of a hexagonal fastener are contacted during engagement and torquing by a single law to achieve continuity of a surface-to-surface, point-to-point, surface-to-surface engagement.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
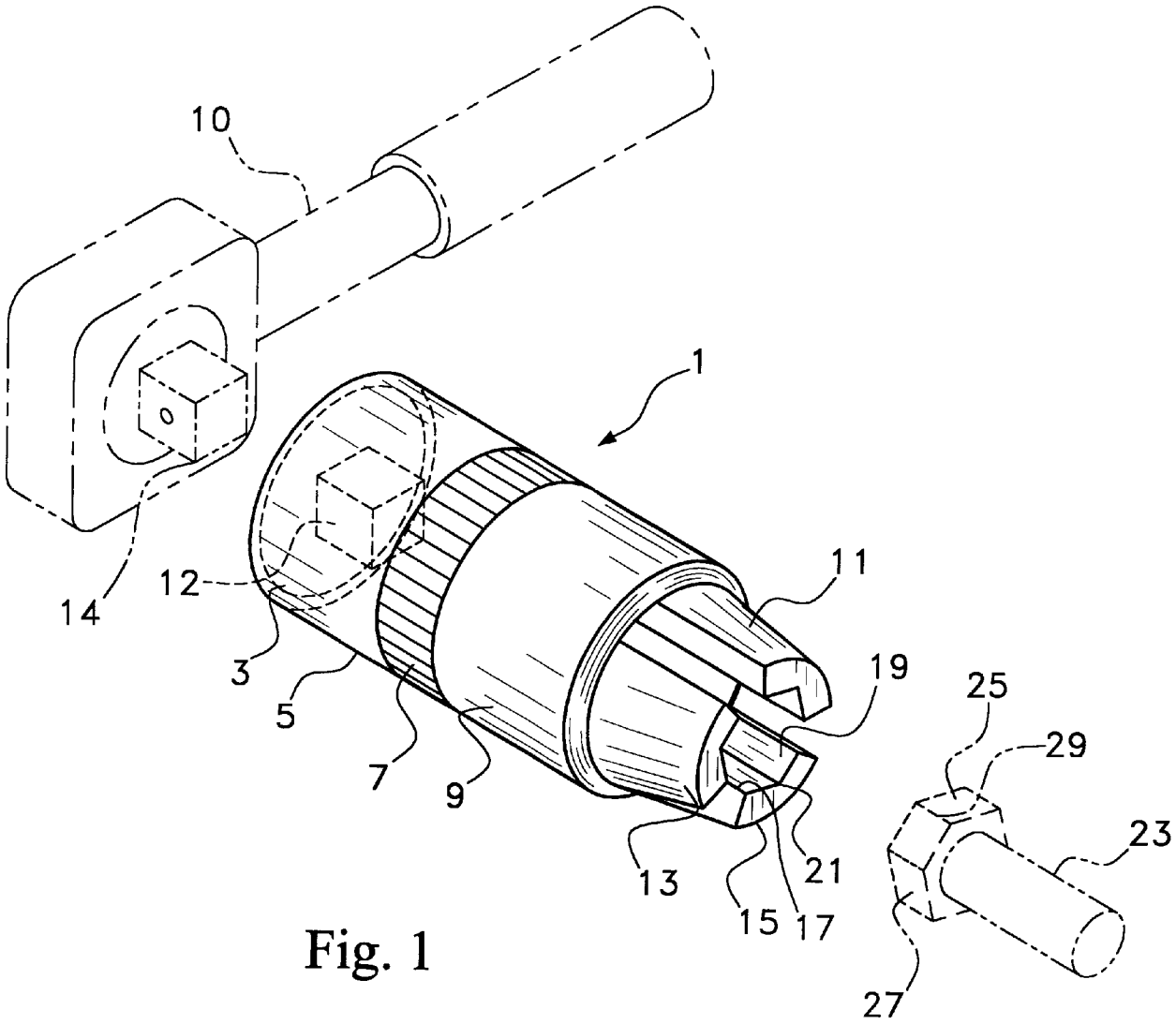
FIG. 1 shows a side oblique view of one embodiment of a present invention adjustable head wrench attachable to a ratchet wrench device.

FIG. 1 shows a side oblique view of one embodiment of a present invention adjustable head wrench 1. It has a typical ratchet wrench female receiver 12 on top 3 of cylindrical main body 5, adapted to receive and attach to ratchet wrench drive mechanism 10 via male insert 14. Adjustable head wrench 1 includes a cylindrical main body 5, an adjuster 7 and a sleeve 9, which contain the inner workings that cause the three jaws 11, 13 and 15 to open and close so as to create the smallest and largest hexagonal "footprint" possible within the confines of the capabilities of the sleeve 9 and of inner workings (illustrated below). The actual inner workings are within the purview of the artisan. In other words, the exact inner workings for open and close three jaws are taught in the above-cited prior art and are well known in the drill chuck aspects of power drills and are thus well within the skills of one of ordinary skill in the art. Thus, the internal mechanism of the opening and closing of three jaws may be any that are available and the present invention should not be limited to the specific embodiments described below.

Referring again to FIG. 1, the critical features of the present invention relate to the three jaws 11, 13 and 15, which maximize the strength and capabilities of the invention. Clearly, may two and three jawed adjustable head arrangements are taught in the prior art. However, there are deficiencies with every one of these prior art devices compared to the present invention. Slippage around a fastener during torque application may occur because of tolerances and it is now clear to this inventor that slippage occurs relative to degree of contact given the same tolerances. In other words, the amount of contact with the fastener determines whether or not a tightly held fastener can be removed or a fastener can be tightly applied without slipping over corners, without wearing down corners or without failing to break a tight fastener's hold before slipping off.

The prior art devices all fail to maximize the contact capabilities and none "shoulder" the fastener. "Shouldering" means fitting a jaw so that a corner (or point) of a hexagonal fastener and the flats (flat surfaces) on each side of the corner are held by a single piece of metal. This is always designed into non-adjustable sockets and wrenches because of the single piece construction. However, in adjustable head wrench 1 of the present invention, each of the three jaws offers surface-to-surface, point-to-point, surface-to-surface contact. This has not been achieved in the prior art. Thus, for example, present invention jaw 15 has a surface 17 an adjacent angle point surface 19 and an angle point 21 therebetween to fully contact a corner of a hexagonal fastener and each of the side surfaces adjacent that corner. For example, bolt 23 has a corner 29 surrounded by surfaces 25 and 27, for engagement by present invention jaw 13 for surface-to-surface, point-to-point, surface-to-surface contact. It is by this unique arrangement that minimum slippage with maximum adjustability is achieved.

Figure 2:
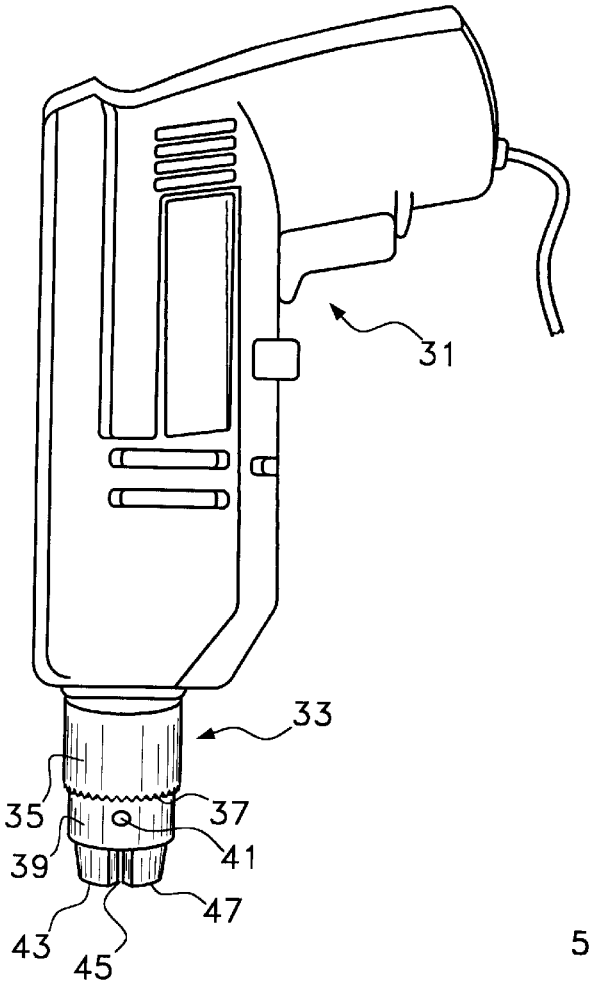
FIG. 2 illustrates a side view of another embodiment of present invention adjustable head wrench attached to a hybrid electric/battery power drill.

FIG. 2, shows a side view of an alternative embodiment present invention wrench 33, attached to power drive mechanism 31, similar to an electric/battery operated power drill. Wrench 33 utilizes a geared chuck 35 and a central cylindrical main body 39 similar to power drills, except that jaws 43, 45 and 47 have the same configuration as those shown in FIG. 1. A conventional key (not shown) in inserted into hole 41, engages gear teeth 37 and when rotated in a first direction, open jaws 43, 45 and 47 relative to one another, and when rotated in a second (opposite) direction closes jaws 43, 45 and 47. Wrench head 33 may be permanently or removably attached, e.g. by a locking screw or by a removable central allen screw typically used with power drill chucks.

Figure 3:
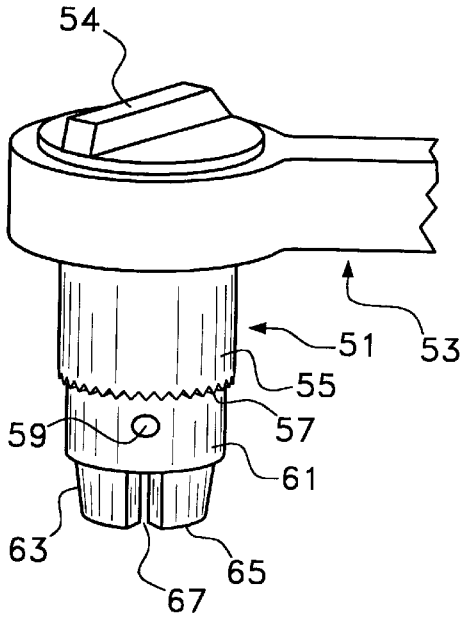
FIGS. 3, 4 and 5 show two side views and a bottom view respectively of another present invention wrench for attachment to a ratchet wrench drive handle, but utilizing a chuck and key adjuster; and, FIGS. 6 through 9 show various oblique side and side cut views of another present invention adjustable head wrench illustrating one choice of internal workings for present invention devices.
Figure 4:
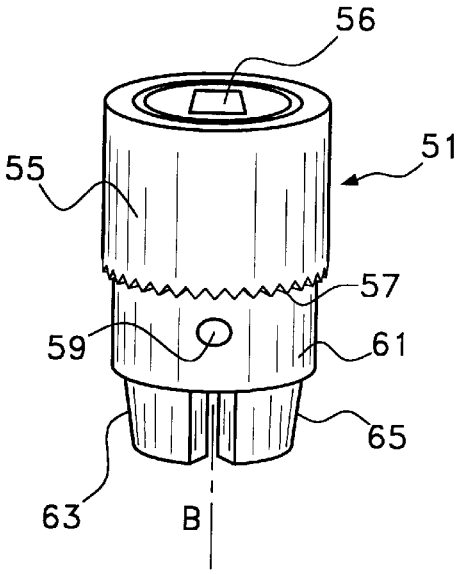
Figure 5:
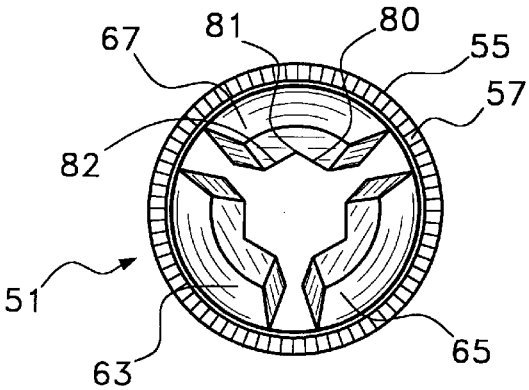

FIGS. 3, 4 and 5 show side oblique, side and bottom views of another present invention embodiment of an adjustable head wrench 51 attached to ratchet wrench drive 53 with reversing lock 54 for selecting and locking clockwise or counterclockwise engagement (FIG. 3). Referring to all three Figures, wrench 51 has a chuck-type adjuster 55 with gear teeth 57. Cylindrical main body 61 includes a key hole 59 for adjustment, operating as discussed above in FIG. 2. Head receiving orifice 56 is included, as well as three jaws 63, 65 and 67 which are arranged symmetrically about longitudinal axis B (FIG. 4). As shown in bottom view FIG. 5, jaw 67 is representative of all three jaws and has a first surface 80 and a second surface 82 forming an angle of about 120° therebetween and a point contact area 81 for contacting a corner of a hexagonal fastener. In some preferred embodiments these surfaces 80 and 82 may be flat and smooth while in other embodiments they may be fluted to enhance gripping by creating small flute cuts parallel to a central axis such as central axis B shown in FIG. 4.

The following Figures illustrate one choice of the inner workings of a present invention device but this detail is merely for illustrative purposes and the invention should not be limited thereto.

Figure 6:
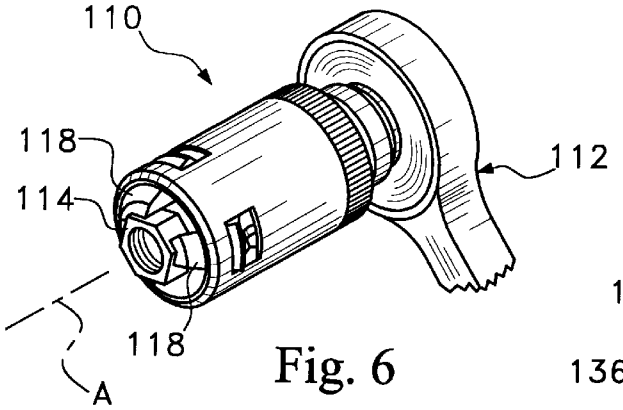

Referring to FIG. 6 of the drawings, an adjustable socket constructed in accordance with the present invention is indicated generally by reference numeral 110 and is illustrated in association with a ratchet wrench 112 for providing rotational driving of the socket about a central axis A. Adjustment of the socket 110 as is hereinafter described permits gripping of a hexagonal fastener, such as a bolt head or a nut, e.g., the nut 114 illustrated for driving rotation about axis A upon application of torque through the ratchet wrench 112.

Figure 7:
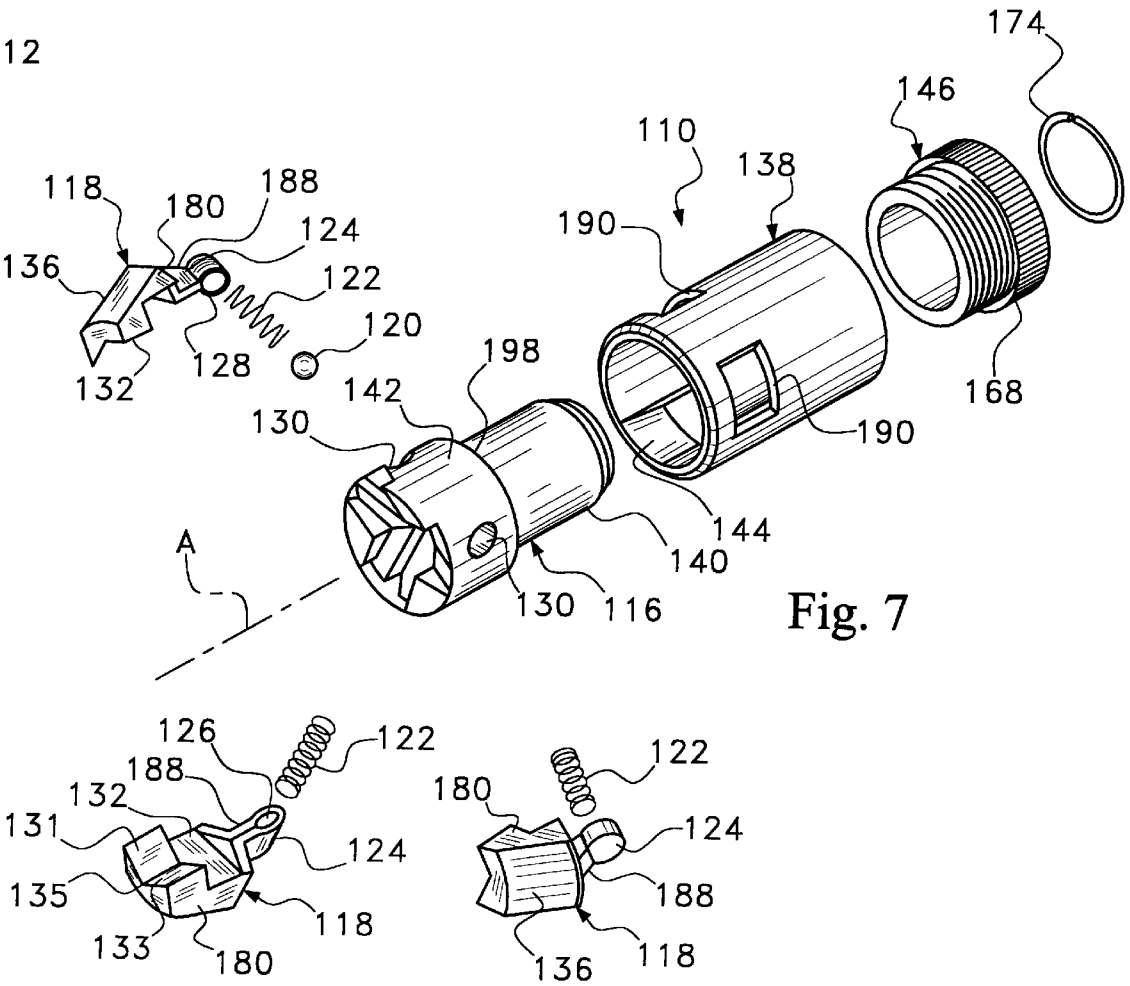

With reference to FIG. 7, one embodiment of the adjustable socket is indicated by 110 and includes a jaw support member 116 having a rotational axis along the central socket axis A about which the socket is rotatively driven. Jaws 118 are mounted on the support member 116 for radial adjusting movement inwardly and outwardly with respect to the rotational axis A so as to permit gripping of hexagonal fasteners, such as bolt heads and nuts of different sizes. An adjustment mechanism for radially positioning the jaws 118 includes a seat embodied by a ball 120 and helical springs 122 respectively associated with the jaws. The ball 120 is positioned along the rotational axis A of the jaw support member 116 and each of the helical springs 122 has an inner end engaged with the ball as well as an outer end engaged with the associated jaw 118. Helical springs 122 bias the jaws 118 outwardly in a radial direction with respect to the rotational axis A of the socket.

Figure 8:
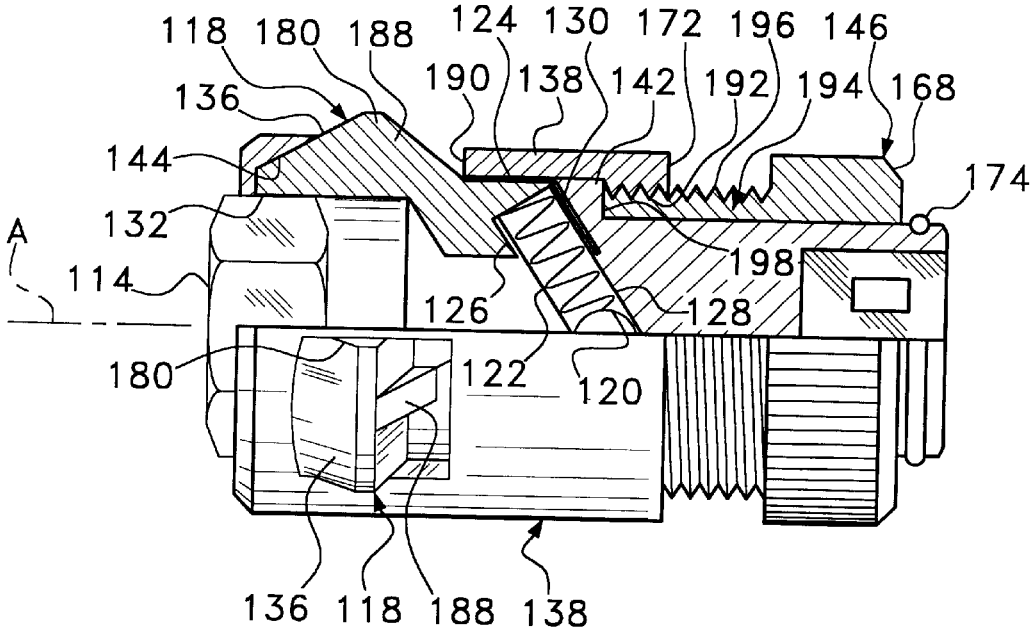
Figure 9:
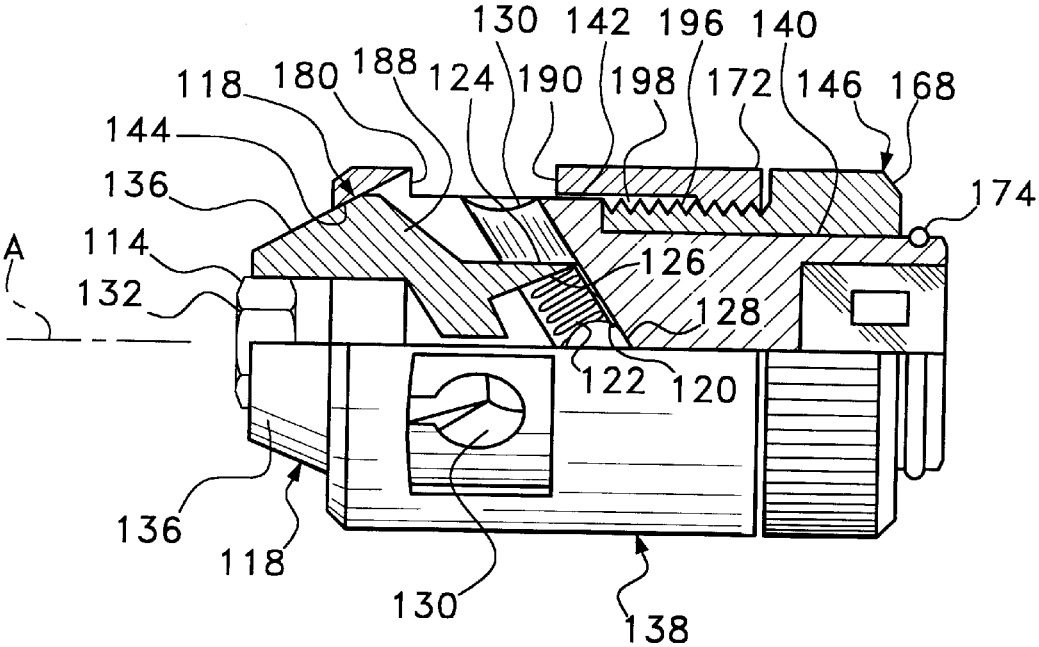

Provision of the ball 120 for seating the inner ends of the helical springs 122 provides an economical and efficient way of biasing the jaws 118 outwardly toward the fully open position as illustrated in FIG. 8 from the fully closed position as illustrated in FIG. 9. Each jaw 118 includes a slide 124 mounted for radial movement on the jaw support member 116 and having an inwardly facing opening 126 that receives the outer end of the associated helical spring 122. An inwardly concave shape 128 of each jaw slide 124 about the opening 126 thereof receives the ball 120 upon inward jaw movement so as to permit inward movement than would otherwise be possible.

The jaw support member 116 having the rotational axis A about which the socket is rotatively driven has slideways 130 that extend radially from the rotational axis. The jaws 118 are respectively associated with the slideways with the slide 124 of each jaw received by the associated slideway of the support member. The adjustment mechanism of the socket moves the jaws 118 along the slideways 130 radially in inward or outward directions with respect to the rotational axis A upon manually actuated adjustment. Each jaw 118 has an engagement portion 132 which includes two flat surfaces 131 and 133 forming a 120° angle 135 to create two adjacent surface-to-surface contacts and an angle point-to-point contact for engagement of a corner and two adjacent surfaces of a hexagonal fastener. These generally face inwardly toward the rotational axis A and extend with a slight inward inclination with respect to the rotational axis in an axial direction away from the slide 124 as illustrated by an angle which is preferably on the order of about 20. Such an inclination of each jaw engagement surface 132 allows the jaws to accommodate for clearance between the slides 124 thereof and the associated slideways 130 by tilting outwardly about the slide. This tilting of the jaws positions the engagement surfaces thereof in a parallel relationship with the rotational axis for gripping of a nut or bolt head by surface-to-surface contact. The inclination of each jaw engagement surface 132 allows the jaw slide 124 and support member slideway 130 to have an accumulated clearance on the order of about fifteen-thousandths of an inch and still function effectively in gripping with a surface-to-surface contact during transmission or torque without requiring more expensive manufacturing operations to hold closer tolerances for the jaw slides and the support member slideways. Intermediate jaw portions 180 and angular intermediate webs 188 maintain lateral positioning during movements and resting of the jaws.

With combined reference to FIGS. 7, 8 and 9, the jaw support member 116 which is driven about the rotational axis A of the socket has the slideways 130 thereof extending radially from the rotational axis with an inclination in one axial direction toward the socket end at which the jaw gripping takes place. Each jaw 118 has its slide 124 received by the associated slideway 130 of the jaw support member 116 for radial movement along a path inwardly and outwardly with concomitant axial movement. Each jaw 118 includes an inwardly facing engagement surface 132 for applying torque during rotational driving of the socket as previously discussed and also includes a camming surface 136 that extends radially with an inclination in the opposite axial direction as the support member slideways 132. The camming surface 136 of each jaw 118 and the path of jaw movement define an angle greater than 90° and preferably on the order of about 95°. The adjustment mechanism of the socket engages the jaw camming surfaces 136 in a manner which is hereinafter described and the angular relationship thereof with respect to the path of jaw movement prevents any binding during both inward and outward jaw movement. Along the path of jaw movement, both the jaw slide 124 and the support member slideway 130 preferably have round cross sections so as to also facilitate the adjusting movement of jaws 118. At their inner ends, the slideways 130 define a somewhat pointed junction with each other for receiving the ball 120 that seats the biasing springs 122.

As seen in FIGS. 7, 8 and 9, the adjustment mechanism of the socket 110 includes a sleeve 138 that receives the jaw support member 116 by insertion of a small round end 140 thereof into the sleeve followed by insertion of an enlarged end 142 thereof on which the jaw slideways 130 are provided. Retaining ring 174 axially engages the top end of adjuster 146 to limit the relative axial movement of the jaw support member 116. The sleeve 138 includes camming surfaces 144 and openings 190 that engage the camming surfaces 136 of the jaws 118 in a slidable relationship to provide inward and outward jaw movement upon axial movement between the jaw support member 116 and the sleeve 138. An adjuster 146 of the socket adjustment mechanism has a sleeve type construction as best seen in FIG. 7 and receives the round end 140 of the jaw support member 116 in a rotatable relationship with respect thereto and with respect to the sleeve 138. The sleeve 138 is moved axially upon rotation of the adjuster 146 to thereby adjust the jaws inwardly or outwardly.

As indicated, helical springs 122 bias the jaws 118 outwardly away from the fully closed position illustrated in FIG. 9 toward the fully open position illustrated in FIG. 8 and the consequent sliding action between the jaw camming surfaces 136 and the sleeve camming surfaces 144 biases the sleeve 138 axially toward the desired direction for opening or closing. Flange 172 of sleeve 138 includes internal threads 192 and adjuster 146 which also includes external threads 196 that mate with the internal threads 192 on the sleeve 138. An annular shoulder 198 of the jaw support member 116 faces away from the enlarged end 142 thereof toward the smaller round end 140 and engages the axial end of the adjuster sleeve 194 under bias of springs 122 in the assembled condition of the socket. Adjusting ring 168 is unitary with the adjuster 146 to facilitate gripping thereof and rotation of the adjuster with respect to the sleeve 138 and the jaw support member 116 so as to move the sleeve axially and thereby adjustably position the jaws 118. Rotation of the adjuster 146 in one direction moves the sleeves 138 toward the right such that the camming surfaces 136 and 144 move the jaws 118 against the bias of springs 122 in an inward direction away from the fully open position shown in FIG. 8 toward the fully closed position shown in FIG. 9. Rotation of the adjuster 146 in the opposite direction moves the sleeves 138 toward the left such that the cooperation of the camming surfaces 136 and 144 and the bias of the springs 122 moves the jaws in a direction from the fully closed position toward the fully open position.

Obviously, numerous modifications and variations of the present invention are possible in light of the above teachings. It is therefore understood that within the scope of the appended claims, the invention may be practiced otherwise than as specifically described herein.

What is claimed is:

1. An adjustable head wrench for attachment to a drive mechanism, for applying torque to hexagonal fasteners, which comprises:

(a) a cylindrical main member having a longitudinal axis and therein attachment means adapted to attach a drive end of a drive mechanism thereto;

(b) three support grooves formed in said cylindrical main member extending generally radially from said longitudinal axis, said three support grooves being arranged about 120 degrees apart from one another;

(c) three separate jaws, each of said jaws having two adjacent inner gripping surfaces of predetermined width, and forming an angle therebetween of about 120 degrees, for simultaneously gripping a corner and two adjacent surfaces of a hexagonal fastener, to create a point-to-point contact at a corner and two surface-to-surface contacts on adjacent surfaces of a hexagonal fastener with a single jaw, each of said jaws having adjustment engagement means adapted to operate at least partially within said three support grooves of said cylindrical main member, each of said jaws being functionally connected to said cylindrical main member and being arranged in a symmetrical circular arrangement about said longitudinal axis; and, (d) adjuster means rotatably connected to said cylindrical main member and functionally interconnected to said three separate jaws wherein said adjuster means includes a key hole adapted to engage gear teeth located on a chuck, whereby when said key hole is turned, said gear teeth are rotated in a first direction and said three jaws retract radially relative to said longitudinal axis so as to move toward one another, and when said key hole is turned in a second direction, being an opposite direction from said first direction, said gear teeth are rotated in said second direction and said three jaws open radially relative to said longitudinal axis so as to move away from one another.

2. The adjustable head wrench of claim 1 wherein said cylindrical main member attachment means for attachment to a drive is means for attachment to a manually driven ratchet wrench drive.

3. The adjustable head wrench of claim 2 wherein said wrench includes an outer collar located above said cylindrical main member which moves along said longitudinal axis relative to said cylindrical main member in cooperation with rotation of said adjuster means, so as to cause said jaws to retract radially and open radially.

4. The adjustable head wrench of claim 3 wherein said collar and said jaws each have contacting cam surfaces and cam action between said jaws and said collar in response to rotation of said adjuster and corresponding movement of said collar.

5. The adjustable head wrench of claim 2 wherein said three support grooves each contain a spring biasing means to stabilize positions of said jaws in various positions from, to and including fully open and fully retracted.

6. The adjustable head wrench of claim 1 wherein said cylindrical main member attachment means is means for attachment to a power drive mechanism selected from the group consisting of battery-powered mechanisms, electrically powered mechanisms and combinations thereof.

7. The adjustable head wrench of claim 6 wherein said wrench includes an outer collar located about said cylindrical main member which moves along said longitudinal axis relative to said cylindrical main member in cooperation with rotation of said adjuster means, so as to cause said jaws to retract radially and open radially.

8. The adjustable head wrench of claim 7 wherein said collar and said jaws each have contacting cam surfaces and cam action between said jaws and said collar in response to rotation of said adjuster and corresponding movement of said collar.

9. The adjustable head wrench of claim 6 wherein said three support grooves each contain a spring biasing means to stabilize positions of said jaws in various positions from, to and including fully open and fully retracted.

10. The adjustable head wrench of claim 1 further including a manually driven ratchet wrench drive mechanism removably attached to said adjustable head wrench.

11. The adjustable head wrench of claim 1 further including a power driven drive mechanism attached to said adjustable head wrench, said power driven drive mechanism being selected from the group consisting of battery-powered mechanisms, electrically powered mechanisms and combinations thereof.

* * * * *